US010472923B2

(12) United States Patent
Kapavarapu et al.

(10) Patent No.: US 10,472,923 B2
(45) Date of Patent: Nov. 12, 2019

(54) TRIM FOR CHOKE

(71) Applicant: M-I L.L.C., Houston, TX (US)

(72) Inventors: Shiva Phani Kapavarapu, Florence, KY (US); Christopher Nicholson, Florence, KY (US); Charles Patrick, Livingston, TX (US)

(73) Assignee: M-I L.L.C., Houston, TX (US)

( * ) Notice: Subject to any disclaimer, the term of this patent is extended or adjusted under 35 U.S.C. 154(b) by 1002 days.

(21) Appl. No.: 14/533,639

(22) Filed: Nov. 5, 2014

(65) Prior Publication Data

US 2016/0123099 A1 May 5, 2016

(51) Int. Cl.

| | |
|---|---|
| ***E21B 34/02*** | (2006.01) |
| ***E21B 44/06*** | (2006.01) |
| ***F04B 49/00*** | (2006.01) |
| ***F17D 3/00*** | (2006.01) |
| ***F16K 47/00*** | (2006.01) |
| ***F16L 58/04*** | (2006.01) |

(52) U.S. Cl.

CPC ..... *E21B 34/02* (2013.01)

(58) Field of Classification Search

None

See application file for complete search history.

(56) References Cited

U.S. PATENT DOCUMENTS 4,531,545 A * 7/1985 Muchow ..... E21B 21/106 137/625.39
4,732,364 A * 3/1988 Seger ..... E21B 34/02 251/122
5,074,519 A * 12/1991 Pettus ..... E21B 34/02 137/375
6,102,828 A 8/2000 Mackenzie
6,189,984 B1 2/2001 Alaze et al.
7,287,739 B2 * 10/2007 Arnison ..... E21B 34/02 251/14
2002/0175303 A1 11/2002 Chatufale
2014/0020909 A1 * 1/2014 McKeon ..... E21B 34/02 166/379

FOREIGN PATENT DOCUMENTS

GB 1195178 A 6/1970
WO 2013/012609 A1 1/2013

OTHER PUBLICATIONS

International Search Report and Written Opinion for the equivalent International patent application PCT/US2015/059139 dated Jun. 22, 2016.

International Preliminary Report on Patentability for the equivalent International patent application PCT/US2015/059139 dated May 9, 2017.

* cited by examiner

*Primary Examiner* — Matthew R Buck
*Assistant Examiner* — Douglas S Wood
(74) *Attorney, Agent, or Firm* — Jeffrey D. Frantz

(57) ABSTRACT

A fluid choke may include a housing and a shuttle configured to move within an interior chamber of the housing. The housing may have a fluid inlet channel and a fluid outlet channel. The shuttle may have a gate connected to an end of the shuttle and the gate may be configured to mate with a seat located in the housing at the fluid outlet channel. The shuttle may be moved within the interior chamber by a pressurized hydraulic fluid configured to apply a hydraulic pressure to a peripheral portion of the shuttle, an inner portion of the shuttle, and the gate.

18 Claims, 8 Drawing Sheets

TRIM FOR CHOKE

BACKGROUND OF THE DISCLOSURE

Wells are drilled on land and in marine environments for a variety of exploratory and extractive purposes. Due to the variety of purposes, the conditions experienced while producing the wells also vary greatly. The particular conditions include changes in temperature, pressure, subterranean fluids, and formations, among other variables. The equipment used, including the configuration of the bottomhole assembly, will be affected by subsurface conditions. Managed Pressure Drilling ("MPD") is used to ensure the pressure within the wellbore is maintained within predetermined limits relative to the surrounding formation pressure. The formation pressure may change during drilling of the wellbore. The applied fluid pressure by the drilling system is increased or decreased to keep the wellbore pressure within the desired limits.

A drilling system includes a drilling rig outside of the wellbore and a drill string with a bottomhole assembly near or at the bottom of the wellbore. The drilling rig often includes a platform, a rotating table, a kelly, pressure control devices such as one or more blowout preventers, a rotating control device ("RCD"), and a choke. The drilling rig stabilizes and controls the upper end of the drill string, which extends downward. The drill string includes drill pipe in segments mated together at threaded joints. The drill pipe provides force transmission and a fluid conduit down to the bottomhole assembly at the end of the drill pipe. The bottom of the drill pipe is connected to the bottomhole assembly. The bottomhole assembly has a variety of equipment and modules that enable operators to monitor and control the drilling progress. The bottomhole assembly includes components such as a drill bit, a drill motor, measurement-while-drilling equipment, logging-while-drilling equipment, and a drill collar.

During drilling, a drilling fluid is pumped from the drilling rig down the fluid conduit within the drill pipe to the bottomhole assembly. The drilling fluid passes through a fluid conduit extending through the bottomhole assembly and passes through the drill bit, producing a positive pressure at the bottom of the wellbore. The composition of the drilling fluid also changes depending on the conditions of the formation through which the wellbore will extend. Generally, however, the drilling fluid is used to lubricate and cool the drill bit while also removing drill cuttings from the wellbore. The drilling fluid flows back up the wellbore in annular gap around the drill string, carrying drill cuttings that are suspended in the drilling fluid.

BRIEF DESCRIPTION OF THE DRAWINGS

In order to describe the manner in which embodiments of the present disclosure may be used, a more particular description will be rendered by reference to specific embodiments as illustrated in the appended drawings. While some of the drawings are schematic representations of systems, assemblies, features, methods, or the like, at least some of the drawings may be drawn to scale. Understanding that these drawings depict example embodiments of the disclosure and are not therefore to be considered to be limiting of the scope of the present disclosure or to scale for each embodiment contemplated herein, the embodiments will be described and explained with additional specificity and detail through the use of the accompanying drawings in which.

DETAILED DESCRIPTION

Figure 1:
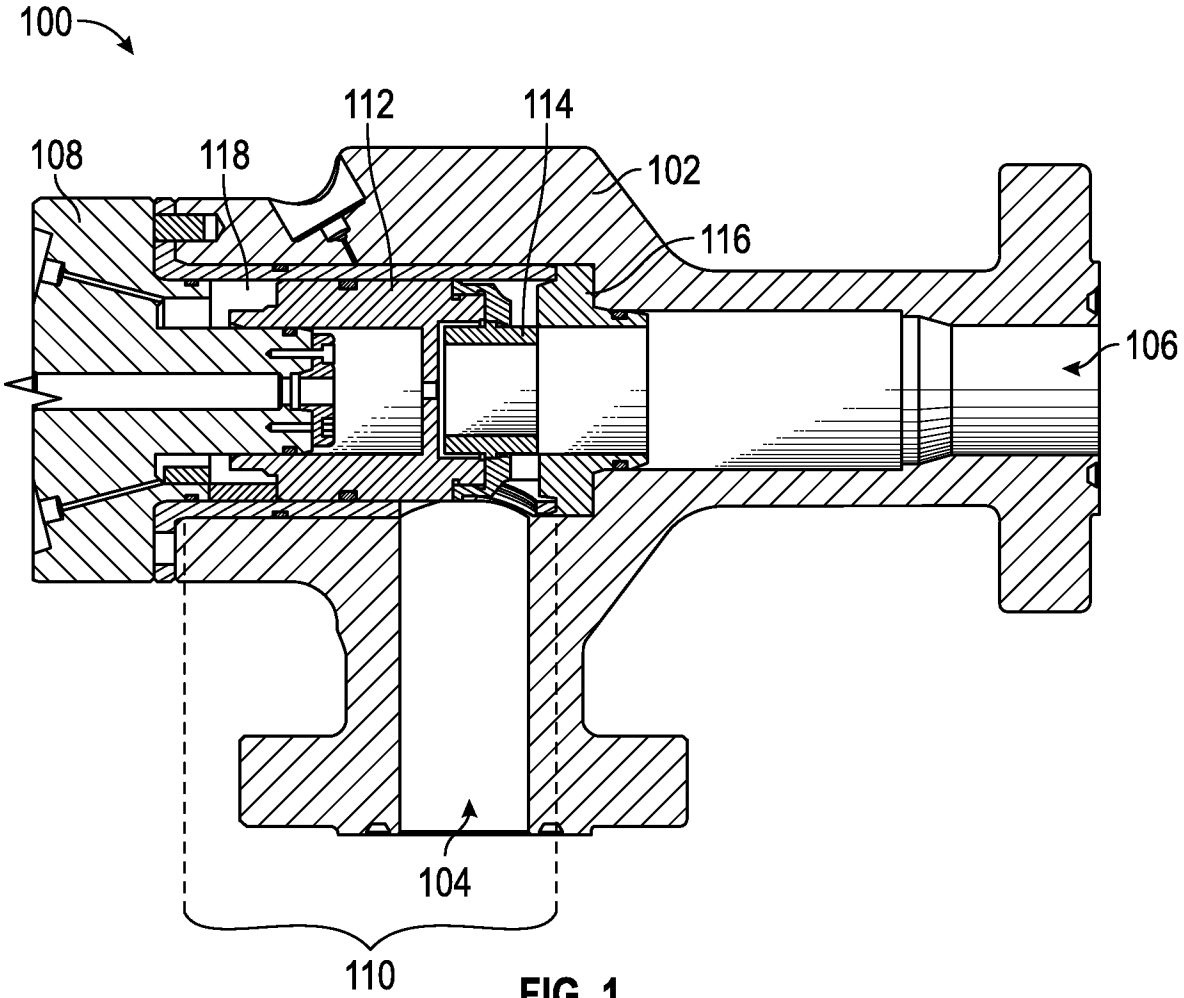
FIG. 1 is a side cross-sectional view of an embodiment of a choke susceptible to erosion by a drilling fluid and suspended particles.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As the drilling fluid and suspended particles reach the top of a drilling system, an RCD may create a closed circulatory path for the drilling fluid pumped into the wellbore. A drilling fluid and suspended particles may be diverted through a fluid choke such as choke 100 depicted in FIG. 1. The choke 100 may include a housing 102 that includes a drilling fluid inlet channel 104 and a drilling fluid outlet channel 106. The choke 100 also may include a bonnet 108 that connects to a portion of the housing 102 to define an interior chamber 110. The interior chamber 110 may house a shuttle 112, which is configured to move longitudinally within the interior chamber 110 and, hence, relative to the housing 102. The shuttle 112 movement may move a gate 114 relative to a seat 116 that is adjacent the drilling fluid outlet channel 106. The shuttle 112 and gate 114 can be urged longitudinally within the interior chamber 110 by the introduction of a hydraulic fluid to a hydraulic fluid chamber 118 in contact with a radial surface of the shuttle 112.

As shown in FIG. 1, the gate 114 may be in contact with the seat 116, constricting the cross-sectional area through which a fluid may pass and may substantially seal the choke 100. The choke 100 may vary the size of the cross-sectional area through which the fluid may pass to the drilling fluid outlet channel 106 and may control the amount of back-pressure on the system. The choke 100 may thereby partially control the amount of fluid pressure inside the wellbore during drilling.

Certain formations produce higher amounts of drill cuttings or drill cuttings in more abrasive forms. Some drilling applications include the use of proppants, such as sand or beads. The suspended particles are abrasive and erode certain components of the drilling system. Parts of the choke are susceptible to erosion and stress from the drilling fluid and suspended particles that flow through the choke. To achieve low flow rates through the choke 100, the gate 114 and seat 116 are held in close proximity to one another, resulting in a small distance between the gate 114 and seat 116. A small radial distance between the gate 114 and seat 116 allows suspended particles in a drilling fluid to abrade or erode the gate 114 and seat 116 faster than a larger radial distance. Some formations produce larger or faster variations in the wellbore pressure. Rapid and/or large changes in wellbore pressure result in rapid and/or large changes in fluid pressure on the choke. These changes in pressure result in movement of some components of the choke.

A fluid choke may regulate a flow rate of a fluid by adjusting the size of the passageway through which the fluid may pass. A fluid choke operating in a low flow environment may be susceptible to abrasion and/or erosion of components during operation. In particular, in environments with a low flow rate and a large amount of suspended particles in the fluid, the size of the passageway through which the suspended particles pass may be closer in size to the suspended particles themselves than in an environment with a high flow rate and a lower amount of suspended particles. For example, in an environment with a high flow rate, a fluid choke may allow a passageway through which the fluid may flow. The passageway may have an area, which may change with the position of the gate relative to the seat. In an environment with a low flow rate, a fluid choke may constrict the passageway such that the fluid encounters a smaller area through which the fluid may flow in order to maintain a backpressure on incoming fluid. The smaller cross-sectional may result in an increased interaction between the suspended particles and components of the fluid choke that may result in damage and/or wear to the fluid choke.

Figure 2:
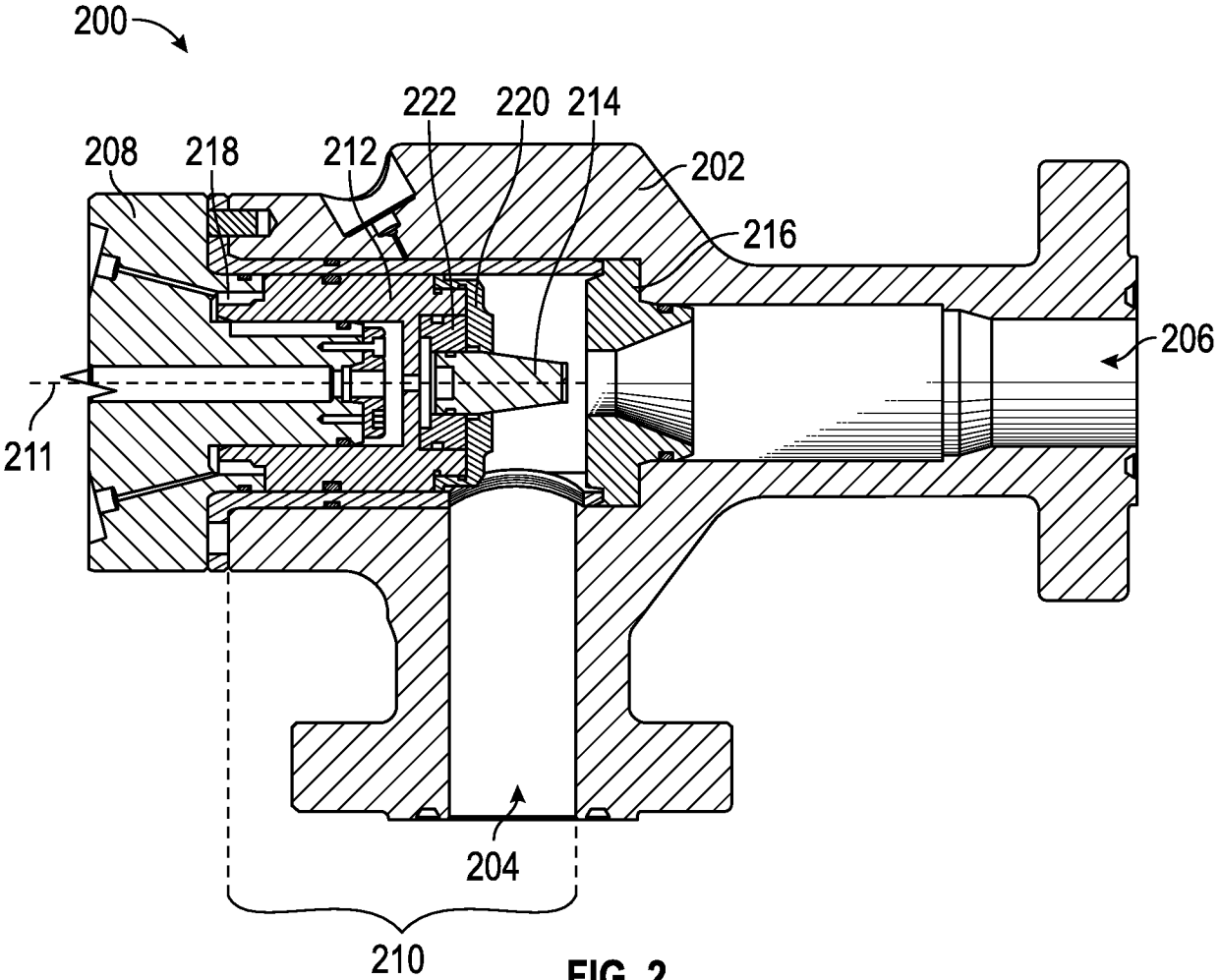
FIG. 2 is a side cross-sectional view of an embodiment of a choke according to the present disclosure that is resistant to erosion by drilling fluid and suspended particles.

FIG. 2 is an embodiment of a choke 200 that may operate at low flow rates and/or in high particulate environments at low fluid pressures. A choke 200 according to the present disclosure may include a housing 202. Housing 202 may be made of or include any material of suitable strength and/or toughness. The housing 202 may be made of or include steel, such as carbon steel (e.g., AISI 10XX, AISI 11XX, AISI 12XX, or AISI 15XX), manganese steel (e.g., AISI 13XX), nickel steel (e.g., AISI 23XX, or AISI 25XX), nickel-chromium steel (e.g., AISI 31XX, AISI 32XX, AISI 33XX, or AISI 34XX), molybdenum steel (e.g., AISI 40XX, or AISI 44XX), chromium-molybdenum steel (e.g., AISI 41XX), nickel-chromium-molybdenum steel (e.g., AISI 43XX, or AISI 47XX), nickel-molybdenum steel (e.g., AISI 46XX, or AISI 48XX), chromium steel (e.g., AISI 50XX, or AISI 51XX), combinations thereof, and the like, where "XX" may range from 1 to 99 and represents the carbon content; titanium alloys; nickel superalloys; other metal alloys; metal matrix carbides, such as tungsten carbide; other suitable materials; or combinations thereof. In one embodiment, the housing 202 may be a weldable material.

The housing 202 may include at least one fluid channel. In some embodiments, the housing 202 may include a plurality of fluid channels. The plurality of fluid channels may include a fluid inlet channel 204 and a fluid outlet channel 206. In some embodiments, a housing 202 may have more than one fluid inlet channel 204 and/or more than one fluid outlet channel 206.

The housing 202 may include a bonnet 208 connected to a portion of the housing 202. The bonnet 208 may be made of or include any of the materials described herein that the housing 202 may be made of or include. The bonnet 208 may be a selectively removable component that is configured to mate with and/or connect to at least a portion of the housing 202. When connected to the housing 202, the bonnet 208 may define at least a portion of an interior chamber 210 of the choke 200. A connection of the bonnet 208 and the housing 202 may provide a fluid seal between the bonnet 208 and housing 202 such that a fluid in an interior chamber 210 may not pass through the connection between the bonnet 208 and the housing 202 except through controllable channels, as will be described in greater detail in relation to FIG. 4. When the bonnet 208 is not connected to the housing 202, the interior chamber 210 may be open to allow access to components contained therein during assembly, maintenance, or repair.

The interior chamber 210 may have a variety of shapes. For example, the interior chamber 210 may have a cross-sectional shape that is circular, oval, or ellipsoid. In another example, the interior chamber 210 may have a cross-sectional shape that is polygonal, such as a triangle, square, pentagon, hexagon, heptagon, octagon, other regular polygon, or an irregular polygon. The bonnet 208 may be partially disposed within the interior chamber 210. In other embodiments, the bonnet 208 may define a portion of the interior chamber 210 without extending into the interior chamber 210.

The interior chamber 210 may have a shuttle 212 located therein. The shuttle 212 may be made of or include any of the materials described herein that the housing 202 and/or bonnet 208 may be made of or include. The shuttle 212 may move within the interior chamber 210 in response to one or more forces applied to the shuttle 212. The shuttle 212 may move within the interior chamber 210 in a longitudinal direction parallel to a longitudinal axis 211 of the interior chamber 210. The shuttle 212 may have one or more components attached thereto that move with the shuttle 212 relative to the housing 202 when the shuttle 212 moves in the interior chamber 210. The shuttle 212 may be generally shaped to match the shape of the interior chamber 210. The shuttle 212 may have a cross-sectional shape that is polygonal, such as a triangle, square, pentagon, hexagon, heptagon, octagon, other regular polygon, or an irregular polygon. The shuttle 212 may form a fluid seal with at least the housing 202 such that the shuttle 212 may divide the interior chamber 210 into more than one fluid chamber.

The shuttle 212 may have a gate 214 connected thereto. The gate 214 may be configured to mate with a seat 216 connected to the housing 202. For example, the gate 214 may have a substantially cylindrical configuration while the seat 216 may include a cavity, a portion of which may be shaped to substantially correspond to the shape of the gate 214. A relative position of the gate 214 and seat 216 may, at least partially, determine the amount of space through which a fluid may pass when flowing through the choke 200 from the fluid inlet channel 204 to the fluid outlet channel 206. The relative position of the shuttle 212 and the housing 202 may, at least partially, determine the amount of space between the gate 214 and the seat 216. Part of the gate 214 may be within the shuttle 212 and part of the gate 214 may extend beyond the shuttle 212. The gate 214 may move relative to the interior chamber 210 when the shuttle 212 moves in a longitudinal direction parallel to the longitudinal axis 211 of the interior chamber 210. The gate 214 and seat 216 may have various cross-sectional shapes such that the gate 214 and seat 216 may form a fluid seal when the gate 214 is moved adjacent to and contacting the seat 216. The gate 214 and seat 216 may have a cross-sectional shape that is polygonal, such as a triangle, square, pentagon, hexagon, heptagon, octagon, other regular polygon, or an irregular polygon. The gate 214 may be tapered (i.e., have a decreasing cross-sectional area) in the direction of the seat 216, as will described in more detail with respect to FIG. 5. The seat 216 may be tapered (i.e., have an increasing cross-sectional dimension) in the direction of the gate 214. The gate 214 may be a solid gate. For example, the gate 214 may be a solid body without any channels, bores, chambers, or openings therethrough.

The gate 214 may be made of any suitable material that is abrasion and/or erosion resistant. The gate 214 may be made of or include different materials depending at least partially upon the application for the choke 200. For example, in an environment in which a water-based fluid may pass through the choke 200 and around the gate 214, the gate 214 may be made of or include a material that may not oxidize readily. In another example, in an environment in which a petroleum-based fluid may pass through the choke 200 and around the gate 214, oxidization may be less of a factor in determining material. Suitable materials for the gate 214 may include steel alloys, titanium alloys, superalloys, other metals, or combinations thereof. In some embodiments, the gate 214 may include any of the steel alloys described in relation to the housing 202, such as a steel alloy including alloying elements such as a carbon, manganese, nickel, chromium, molybdenum, tungsten, vanadium, silicon, boron, lead, another appropriate alloying element, or combinations thereof. In other embodiments, the gate 214 may include a titanium alloy including alloying elements such as aluminum, vanadium, palladium, nickel, molybdenum, ruthenium, niobium, silicon, oxygen, iron, another appropriate alloying element, or combinations thereof. In yet other embodiments, the gate 214 may include a superalloy including elements such as nickel, cobalt, iron, chromium, molybdenum, tungsten, tantalum, aluminum, titanium, zirconium, rhenium, yttrium, boron, carbon, another appropriate alloying element, or combinations thereof. In further embodiments, the gate 214 may include a superhard material such as tungsten carbide, cubic boron nitride, polycrystalline diamond, rhenium boride, boron carbide, other materials with a hardness value exceeding 40 gigapascals, or combinations thereof.

The seat 216 may be made of or include different material or materials as the gate 214. The seat 216 may be located partially within the interior chamber 210, partially within the fluid outlet channel 206, or a combination thereof. As depicted in FIG. 2, the seat 216 defines a portion of the interior chamber 210 and a portion of the fluid outlet channel 206.

A distance between the gate 214 and the seat 216 may be determined and/or controlled by a position of the shuttle 212 relative to the housing 202 and/or bonnet 208. The position of the shuttle 212 relative to the housing 202 and/or bonnet 208 may be partially determined by hydraulic pressure within a shuttle hydraulic fluid chamber 218. The shuttle hydraulic fluid chamber 218 may be at least partially defined by the bonnet 208 and the shuttle 212.

Changes in the hydraulic pressure within the shuttle hydraulic fluid chamber 218 may move the shuttle 212 relative to the housing 202. Changes in the hydraulic pressure within the shuttle hydraulic fluid chamber 218 may move the gate 214 relative to the seat 216. The gate 214 may remain fixed relative to the housing 202 by a shuttle nut 220 connected to the shuttle 212 and the gate 214. The shuttle nut 220 may form a connection around or substantially around a perimeter or circumference of the gate 214. The shuttle nut 220 may prevent or limit movement of the gate 214 relative to the shuttle 212. The shuttle nut 220 may prevent or limit the movement of a spacer ring 222 relative to the shuttle 212 and/or the gate 214. The shuttle nut 220 may connect to the shuttle 212 in any suitable manner. In some embodiments, the shuttle nut 220 may connect to the shuttle 212 by a mechanical locking connection, such as threads or interlocking protrusions and recesses. In at least one embodiment, the shuttle nut 220 may include lateral recesses that interlock with lateral protrusions on the shuttle 212 to prevent or limit axial movement of the shuttle nut 220 relative to the shuttle 212. In other embodiments, the shuttle nut 220 may connect to the shuttle 212 by a material bond. For example, the shuttle nut 220 may be welded and/or brazed to the shuttle 212.

Figure 3:
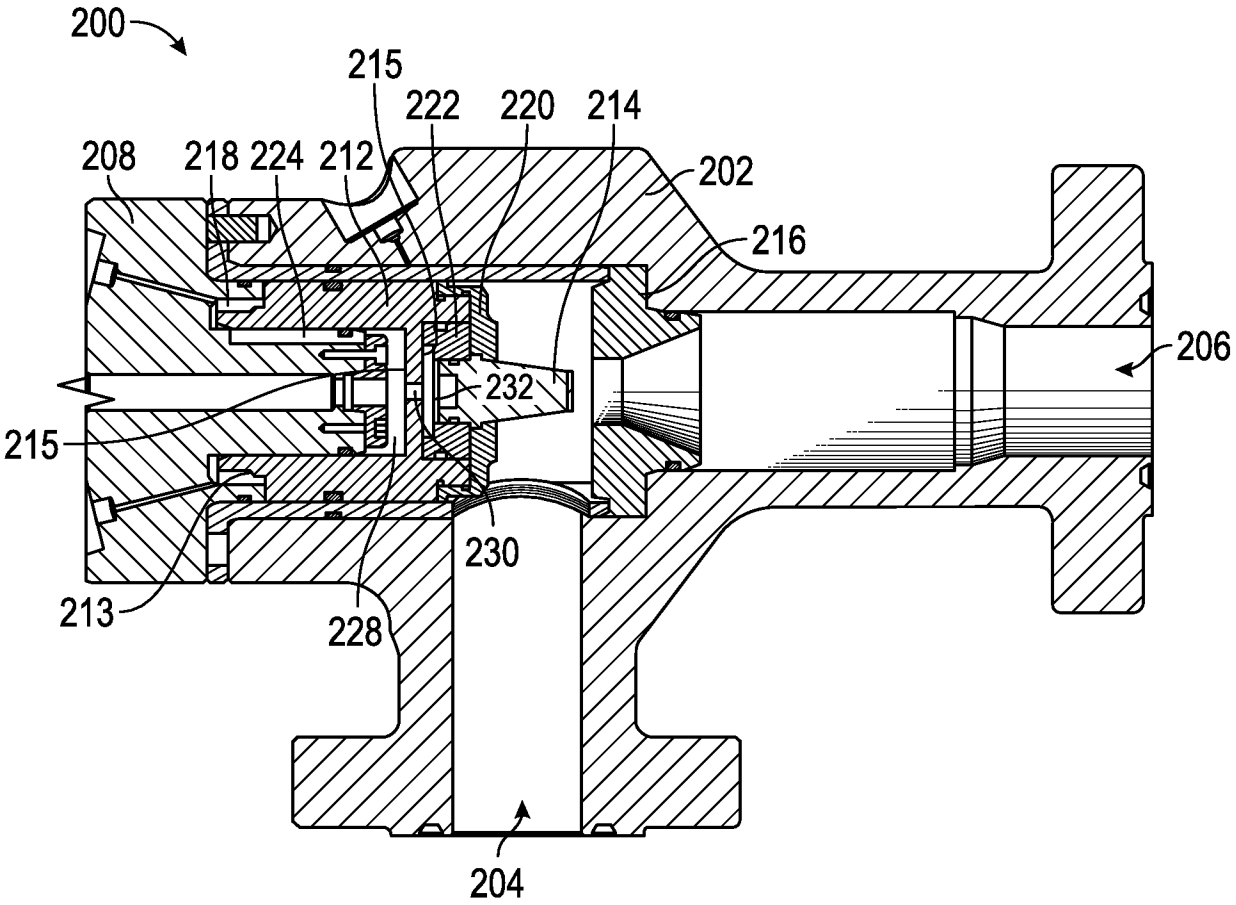
FIG. 3 is a side cross-sectional view of the embodiment of the choke in FIG. 2 including a plurality of hydraulic fluid chambers.

FIG. 3 is a cross-sectional view of the choke 200 that includes a gate hydraulic fluid chamber 232 configured to apply hydraulic pressure to the gate 214. The gate hydraulic fluid chamber 232 may provide fluid communication to the shuttle hydraulic fluid chamber 218 by way of a shuttle hydraulic fluid channel 224, a post hydraulic fluid chamber 228, and a gate hydraulic fluid channel 230.

In some embodiments, the shuttle hydraulic fluid channel 224 may be at least partially defined by the shuttle 212 and the housing 202. While both the shuttle hydraulic fluid chamber 218 and the gate hydraulic fluid chamber 232 may apply hydraulic pressure to the shuttle 212, the shuttle hydraulic fluid chamber 218 and the gate hydraulic fluid chamber 232 may apply hydraulic pressure to different parts of the shuttle 212 and/or in different directions. In some embodiments, the shuttle hydraulic fluid chamber 218 may apply a hydraulic pressure to the bonnet 208 and a peripheral portion 213. In other embodiments, the gate hydraulic fluid chamber 232 may apply a hydraulic pressure to the bonnet 208, the gate 214, a spacer ring 222, and an interior portion 215 of the shuttle 312.

In some embodiments, the choke 200 may include more than one shuttle hydraulic fluid channel 224 that provides fluid communication between the shuttle hydraulic fluid chamber 218 and the post hydraulic fluid chamber 228. In other embodiments, the shuttle hydraulic fluid channel 224 may be a bore through the shuttle 212 itself and may not be defined by the bonnet 208. In yet other embodiments, the shuttle hydraulic fluid channel 224 may include a bore through the housing 202. The post hydraulic fluid chamber 228 may be partially defined by the bonnet 208 and the shuttle 212. The post hydraulic fluid chamber 228 may be in fluid communication with the gate hydraulic fluid chamber 232 via a gate hydraulic fluid channel 230. The gate hydraulic fluid channel 230 may extend through at least a portion of the shuttle 212 to provide fluid communication between an interior of the shuttle 212 and an exterior of the shuttle 212.

Figure 4:
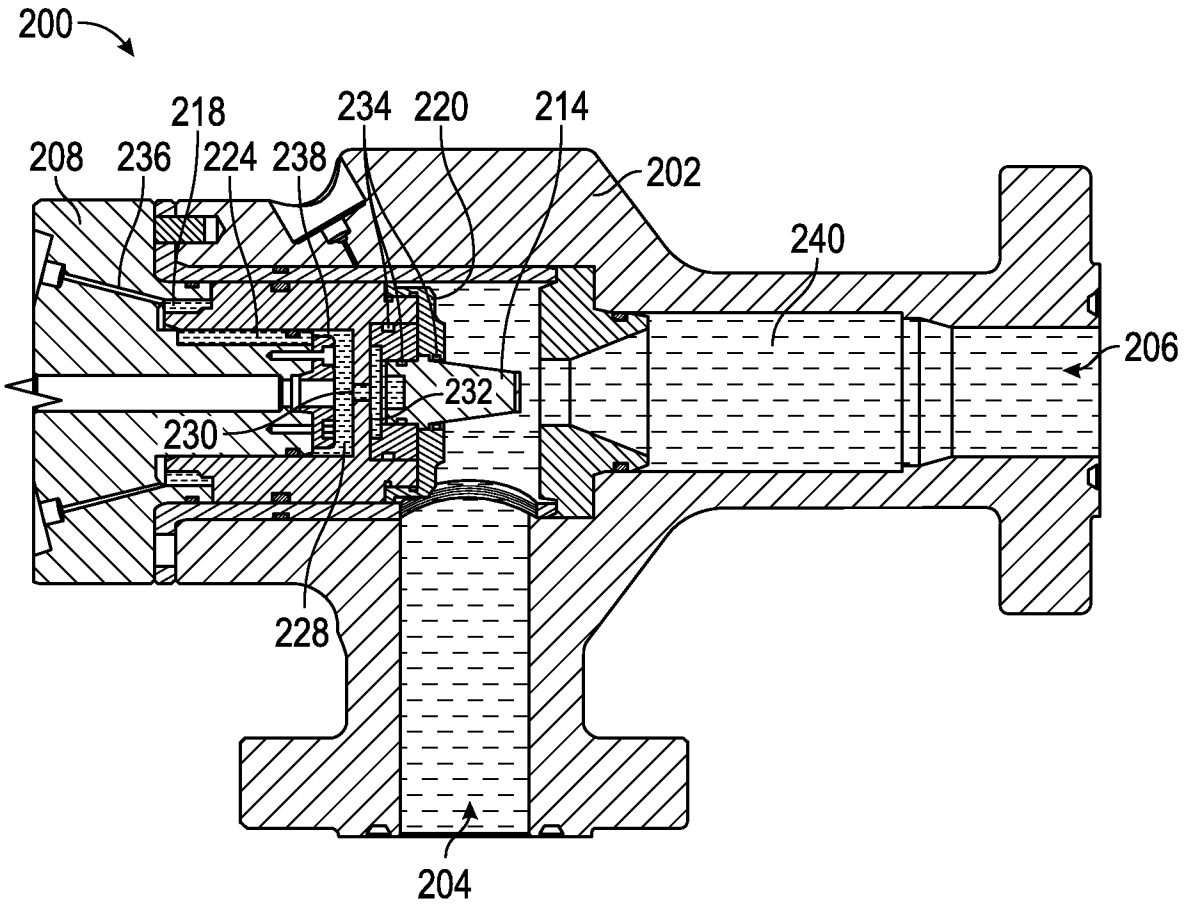
FIG. 4 is a side cross-sectional view of the embodiment of the choke in FIG. 2 having fluid therein.

When the shuttle hydraulic fluid chamber 218, shuttle hydraulic fluid channel 224, post hydraulic fluid chamber 228, gate hydraulic fluid channel 230, and gate hydraulic fluid chamber 232; or a combination thereof; are connected in fluid communication with one another, a hydraulic fluid may be provided therein as shown in FIG. 4. The choke 200 may be configured such that a hydraulic fluid may apply hydraulic pressure directly (i.e., in contact with) the bonnet 208, the shuttle 212, the spacer ring 322, the gate 214, the housing 202, the shuttle nut 220, or any combination thereof.

FIG. 4 is a cross-section of the choke 200 with a hydraulic fluid 238 and a working fluid 240 flowing therein or therethrough. A hydraulic pressure of the hydraulic fluid 238 may be substantially equal throughout the choke 200. The hydraulic pressure may apply a hydraulic force between the bonnet 208 and the shuttle 212, moving the shuttle 212 within the housing 202. The hydraulic fluid 238 may be delivered to the choke 200 by one or more hydraulic fluid inlets 236. In the depicted embodiment, the one or more hydraulic fluid inlets 236 may extend through the bonnet 208. In other embodiments, the one or more hydraulic fluid inlets 236 may extend through the housing 202, through the bonnet 208, through the shuttle 212, or a combination thereof. The hydraulic fluid 238 may be within the shuttle hydraulic fluid chamber 218, the shuttle hydraulic fluid channel 224, the post hydraulic fluid chamber 228, the gate hydraulic fluid channel 230, the gate hydraulic fluid chamber 232, or combinations thereof. The gate hydraulic fluid chamber 232 may be at least partially defined by the gate 214. The gate 214 may be in direct contact with both the hydraulic fluid 238 and the working fluid 240. In at least one embodiment, the hydraulic fluid 238 may be within the hydraulic fluid inlets 236, the shuttle hydraulic fluid chamber 218, the shuttle hydraulic fluid channel 224, the post hydraulic fluid chamber 228, the gate hydraulic fluid channel 230, and the gate hydraulic fluid chamber 232 such that increasing the pressure of the hydraulic fluid 238 at the hydraulic fluid inlets 236 may apply a force to the gate 214.

The working fluid 240 may be any fluid having a flow that may be desirable to regulate. In some embodiments, the working fluid 240 may be a drilling fluid. For example, the working fluid 240 may be a water-based drilling mud, an oil-based drilling mud, or a combination thereof. The working fluid 240 may contain particulate matter suspended therein. As used herein, "suspended" should understand to refer to any particulate matter mobilized and carried by the working fluid 240, whether in suspension in the fluid or mixed in the working fluid 240.

The working fluid 240 may enter through the fluid inlet channel 204 and exit through the fluid outlet channel 206 in the housing 202. The fluid inlet channel 204 and fluid outlet channel 206 are depicted at a 90° angle from one another. It should be understood that the fluid inlet channel 204 and fluid outlet channel 206 may be oriented relative to one another at any appropriate angle including any angle within a range having upper and lower values including any of 20°, 30°, 40°, 50°, 60°, 70°, 80°, 90°, 100°, 110°, 120°, 130°, 140°, 150°, 160°, 170°, or any value therebetween. For example, the fluid inlet channel 204 and the fluid outlet channel 206 may be oriented at angle within a range between 40° and 80°, between 50° and 70°, or at an angle of 60°. The angle between the fluid inlet channel 204 and the fluid outlet channel 206 may affect the flow rate of the working fluid 240 through the choke 200 at various places within the choke.

The working fluid 240 may apply a working fluid pressure to at least the gate 214, shuttle nut 220, shuttle 212, or a combination thereof while moving from the fluid inlet channel 204 to the fluid outlet channel 206. The working fluid pressure applied to the gate 214, shuttle nut 220, shuttle 212, or a combination thereof may be substantially equal to the hydraulic pressure applied by the hydraulic fluid 238 to the gate 214, shuttle nut 220, shuttle 212, or a combination thereof. The working fluid 240 and hydraulic fluid 238 may each apply a hydraulic pressure to substantially opposing surfaces of the gate 214. The balancing of the hydraulic pressure and the working fluid pressure is described in more detail in relation to FIG. 6. The working fluid 240 and hydraulic fluid 238 may be separated from one another by one or more fluid seals 234 located at interfaces within the choke 200. In an embodiment, the choke 200 may include fluid seals 234 at interfaces between the gate 214 and the shuttle nut 220, between the gate 214 and the spacer ring 222, between the shuttle nut 220 and the shuttle 212, between the spacer ring 222 and the shuttle 212, between other components, or any combination thereof. In at least one embodiment, the fluid seal 234 between the gate 214 and the shuttle nut 220 may form a circumferential seal about the entire circumference of the gate 214.

Figure 5:
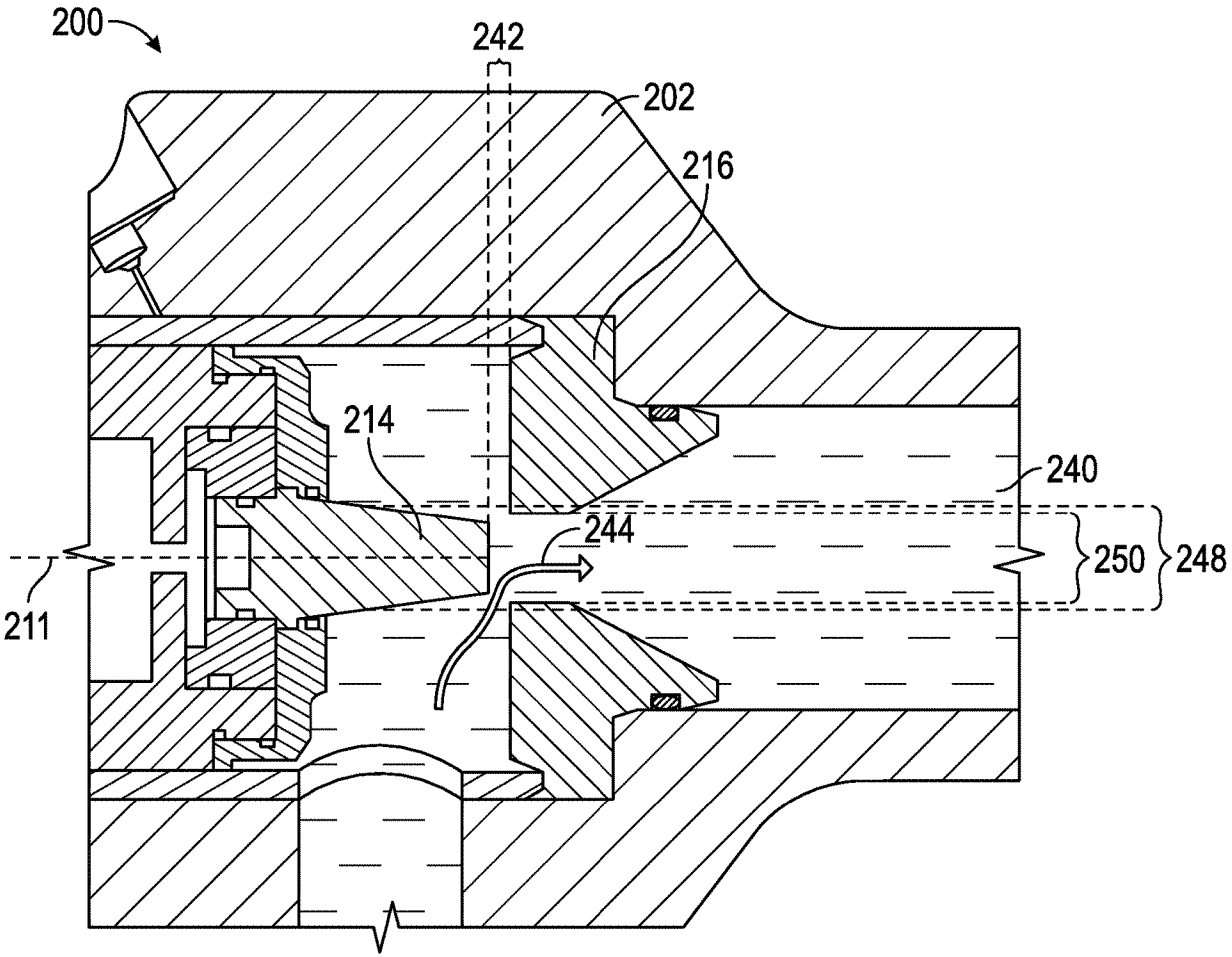
FIG. 5 is a cutaway, side cross-sectional detail view of the embodiment of the choke in FIG. 2 depicting the flow of a fluid therethrough.

FIG. 5 is a cutaway, cross-sectional view of the choke 200 with a tapered gate 214 and depicts a flow 244 of working fluid 240 through a gap 242 between the tapered gate 214 and the seat 216. The tapered gate 214 may allow for more gradual changes to the area through which the flow 244 may pass as the gate 214 moves relative to the seat 216. The gate 214 may have a cross-sectional gate width 248 (i.e., a diameter when the tapered gate 214 is frustoconical) that is perpendicular to the longitudinal axis 211 of the shuttle 212. The gate width 248 may decrease farther from the shuttle 212 (i.e., toward the seat 216). In some embodiments, the gate width 248 may decrease constantly. For example, the gate 214 may have a linear taper. In other embodiments, the gate width 248 may decrease non-linearly. For example, the gate 214 may have a longitudinally curved surface. In at least one particular embodiment, the gate 214 may have a gate width 248 less than 2.0 inches (5.1 cm). In some embodiments, the seat 216 may have an inner width 250 (i.e., diameter when the seat is circular in cross-section) that is greater than the smallest value of the gate width 248. The seat 216 may have an inner width 250 that is less than the largest value of the gate width 248. For example, the gate 214 and seat 216 may be sized such that a portion of the gate 214 but not the entire gate 214 may be positioned within the seat 216. More particularly, the inner width 250 of the seat 216 may be sized such that at least a portion of the gate 214 may enter the seat 216. The gate width 248 may vary in the direction of the longitudinal axis 211 such that a portion of the gate 214 may strike or abut the seat 216. The gate 214 and the seat 216 may contact at a point along the gate 214 when the gate width 248 is substantially the same as the seat width 250. The contact of the gate 214 and the seat 216 may prevent further movement of the gate 214 toward the seat 216 and to create a fluid seal between the gate 214 and the seat 216.

In some embodiments, the gap 242 may regulate a flow rate through the choke 200. For example, the choke 200 may allow a flow rate within a range having upper and lower values including 9 gallons per minute ("GPM") (34 liters per minute ["LPM"]), 12 GPM (45 LPM), 15 GPM (57 LPM), 18 GPM (68 LPM), 21 GPM (80 LPM), 24 GPM (91 LPM), 27 GPM (102 LPM), 30 GPM (114 LPM), 33 GPM (125 LPM), 36 GPM (136 LPM), 39 GPM (148 LPM), 42 GPM (159 LPM), 45 GPM (170 LPM), or any value therebetween. For example, the choke 200 may allow a flow rate in a range between 12 GPM (45 LPM) and 42 GPM (159 LPM). In another example, the choke 200 may allow a flow rate between 21 GPM (80 LPM) and 32 GPM (121 LPM).

Figure 6:
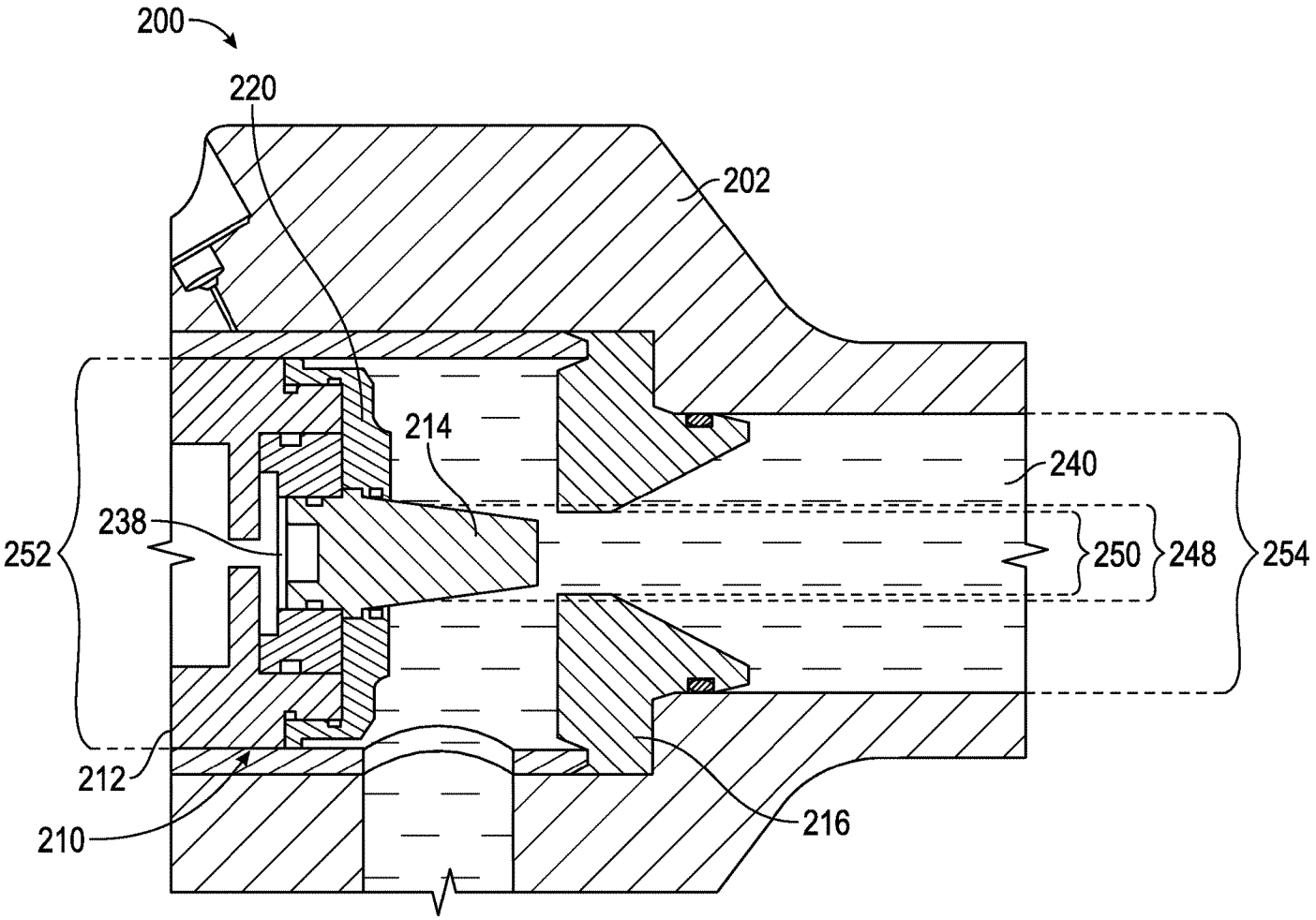
FIG. 6 is a cutaway, side cross-sectional detail view of the embodiment of the choke in FIG. 2 demonstrating balanced fluid pressures.

FIG. 6 is a cutaway, cross-sectional view of the choke 200 depicting the balancing of fluid pressures on each side of the shuttle nut 220 and the gate 214. The working fluid pressure of the working fluid 240 on the shuttle nut 220 and the gate 214 may balance against a hydraulic pressure of the hydraulic fluid 238 against the shuttle 212 and the gate 214. The hydraulic fluid 238 may apply a force to the shuttle 212 similarly to the hydraulic fluid 238 described in relation to FIG. 4. In some embodiments, the working fluid pressure of the working fluid 240 applied to the gate 214 and shuttle nut 220 may be at least partially dependent upon the surface area of the gate 214 and the shuttle nut 220. For example, the working fluid pressure of the working fluid 240 applied to the gate 214 and shuttle nut 220 may be at least partially dependent upon a proportion of a gate width 248 and an interior cross-sectional width 252 of the interior chamber 210.

A more tapered gate will provide higher resolutions of control due to the varied flow areas (vena contracta) produced due to the movement of the tapered edge. Moreover, the hydraulic fluid pressure applied to the shuttle may be distributed substantially evenly across the shuttle 212, shuttle nut 220, and gate 214 which provides a more uniform distribution of hydrostatic force on the shuttle 212, shuttle nut 220, and gate 214, or a combination thereof by the hydraulic fluid when compared to the choke 100 in FIG. 1, which may better counteract a dynamic working fluid pressure applied by a working fluid 640.

The gate width 248 may be smaller than the interior cross-sectional width 252 of the interior chamber 210. In some embodiments, a ratio of gate width 248 to interior cross-sectional width 252 may be within a range having upper and lower values including 0.10, 0.15, 0.20, 0.25, 0.30, 0.35, 0.40, 0.45, 0.50, or any value therebetween. For example, the ratio of gate width 248 to interior cross-sectional width 252 may be between 0.10 and 0.40, between 0.15 and 0.35, or between 0.25 and 0.30. In other embodiments, the ratio of gate width 248 to interior cross-sectional width 252 may be less than one-half. In yet other embodiments, the ratio of gate width 248 to interior cross-sectional width 252 may be less than one-third. In embodiments in which the gate 214 and/or the interior chamber 210 do not have a constant width about a perimeter (i.e., the gate 214 and/or the interior chamber 210 do not have a 1:1 aspect ratio about a rotational axis), a gate cross-sectional area and an interior chamber cross-sectional area may have a ratio within a range having upper and lower values including 0.050, 0.075, 0.100, 0.125, 0.150, 0.175, 0.200, 0.225, 0.250, or any value therebetween. For example, the ratio of gate area to interior cross-sectional area may be between 0.050 and 0.250, between 0.100 and 0.150, or between 0.125 and 0.150. In other embodiments, the ratio of gate area to interior cross-sectional area may be less than 1 to 9.

In some embodiments, the seat inner width 250 may be less than an outlet interior diameter 254. A ratio of seat inner width 250 to outlet interior diameter 654 may be within a range having upper and lower values including 0.10, 0.15, 0.20, 0.25, 0.30, 0.35, 0.40, 0.45, 0.50, or any value therebetween. For example, the ratio of seat inner width 250 to outlet interior diameter 254 may be between 0.10 and 0.40, between 0.15 and 0.35, or between 0.25 and 0.30. In other embodiments, the ratio of seat inner width 250 to outlet interior diameter 254 may be less than one-half.

Figure 7:
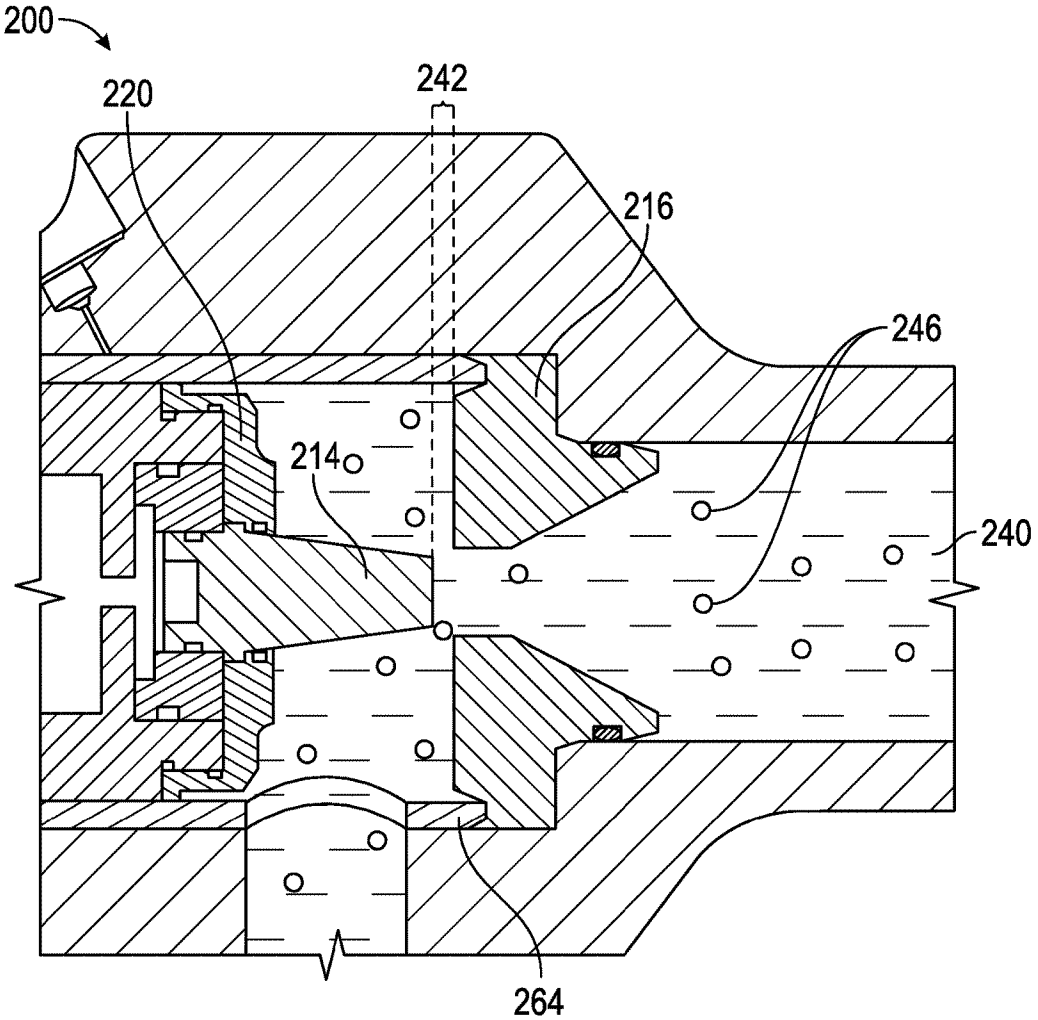
FIG. 7 is a cutaway, side cross-sectional view of the embodiment of the choke in FIG. 2 having a fluid and particulates therein.

FIG. 7 is a cutaway, cross-sectional view of an embodiment of the choke 200 depicting particulate matter 246 suspended in the working fluid 240. The particulate matter 246 may flow through the choke 200 and through a gap 242 between a gate 214 and a seat 216 as the working fluid 240 flows through the choke 200. The particulate matter may be of any variety that may be suspended in the working fluid 240. For example, the particulate matter 246 may be cuttings resulting from drilling a borehole, i.e., drill cuttings. The drill cuttings may include pieces of surrounding formation (i.e., rock); pieces of sand, beads, or other propants used in hydraulic fracturing; swarf generated from milling a casing or other metal present in a downhole environment; or a combination thereof. The individual pieces of particulate matter 246 may have varying dimensions. The particulate matter 246 may be abrasive and may damage the gate 214 and/or seat 216 if the gap 242 is smaller than an upper particulate matter dimension. In at least one embodiment, the choke 200 may be configured to provide a gap 242 larger than an anticipated upper particulate matter dimension. For example, when the choke 200 is used to regulate flow back from a hydraulic fracturing system, a proppant used in the system may have a known range of particulate matter dimensions. The particulate matter dimensions may be based on an average dimensional basis. For example, for non-uniformly shaped particulates, the particulate may have multiple major dimensions. In other words, a more oblong particulate shape may have a major (i.e., largest) dimension in a first axis (i.e., in an x-axis) and a minor dimension in a second axis perpendicular to the first axis (i.e., in a y-axis).

In at least one embodiment, a choke according to the present disclosure may provide a gap configured to allow passage of an anticipated upper particulate matter dimension while providing a smaller passageway through which a fluid may flow, and thereby maintaining a lower flow rate, than a choke according to FIG. 1 that provides a gap configured to allow passage of the same anticipated upper particulate matter dimension. For example, if a choke is operated in an environment having proppant particles of up to 5 mm, a choke may provide a gap of 10 millimeters to provide clearance for the proppant particles to flow through a passageway between a gate and a seat. A choke according to the present disclosure may provide a smaller passageway area with a 10 millimeter gap as compared to a passageway of a choke according to FIG. 1 that may also provide a gap of 10 millimeters.

By allowing for increased gap sizes, and hence increased clearance for particles passing through a passageway the choke 200 may allow for an increase in wear resistance from the working fluid 240 and particulate matter 246. An increase in wear resistance may include lower rates of wear and/or removal of the material comprising the gate 214, the shuttle nut 220, the seat 216, an interior chamber liner 264, or combinations thereof.

Figure 8:
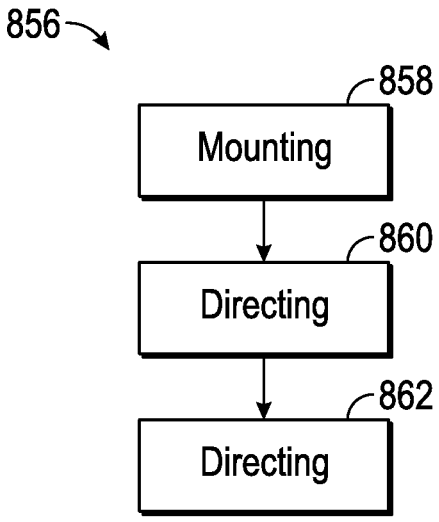
FIG. 8 is a flowchart of an embodiment of a method of regulating flowrate of a fluid using a choke as described.

FIG. 8 depicts a method 856 of regulating a flow rate using a choke according to the present disclosure. The method 856 may include mounting 858 a shuttle to be movable inside a housing. The shuttle may be movable in a first direction and in a second, opposite direction. The shuttle may include a peripheral portion and an inner portion. The pressurized hydraulic fluid may be directed 860 to the peripheral portion. The pressurized hydraulic fluid may be directed 862 to the inner portion. The inner portion may be located distally farther in the first direction than the peripheral portion. In some embodiments, the peripheral portion may partially define a shuttle hydraulic fluid chamber, such as shuttle hydraulic fluid chamber 218 in FIG. 3. In other embodiments, the inner portion may partially define a gate hydraulic fluid chamber such as gate hydraulic fluid chamber 232 in FIG. 3.

In at least one embodiment, a choke according to the present disclosure may exhibit improved wear resistance relative to the choke 100 described in relation to FIG. 1. A choke having improved wear resistance may include a solid gate and/or a gate and seat that have a smaller width relative to an interior chamber width. A choke having improved wear resistance may also include hydraulic fluid chambers in an inner portion of a shuttle such that hydraulic fluid applies a hydraulic pressure to an inner portion of the shuttle and/or to the gate directly.

While embodiments of chokes have been primarily described with reference to RCDs and wellbore drilling operations, a choke according to the present disclosure may be used in applications other than the drilling of a well. In other embodiments, a choke according to the present disclosure may be used outside a well or other downhole environment used for the production of natural resources. For instance, a choke of the present disclosure may be used in a borehole used for placement of utility lines. Additionally, the choke of the present disclosure may be used in any application involving pressurized fluids including particulate matter and/or flow at a low flow rate. Accordingly, the term "wellbore" should not be interpreted to limit tools, systems, assemblies, or methods of the present disclosure to any particular industry or field.

The term "substantially" as used herein represent an amount close to the stated amount that still performs a desired function or achieves a desired result. For example, the term "substantially" may refer to an amount that is within less than 10% of, within less than 5% of, within less than 1% of, within less than 0.1% of, and within less than 0.01% of a stated amount. Further, it should be understood that any directions or reference frames in the preceding description are merely relative directions or movements. For example, any references to "up" and "down" are merely descriptive of the relative position or movement of the related elements. Any specific values described herein should be understood to not be limited to that value, but rather to encompass that value and associated values within a range within less than 10% of, within less than 5% of, within less than 1% of, within less than 0.1% of, and within less than 0.01% of a stated amount.

It should also be understood that while several embodiments are described, any element described in relation to any embodiment may be combined with any element described in relation to any other embodiment, as appropriate.

Although the preceding description has been described herein with reference to particular means, materials and embodiments, it is not intended to be limited to the particulars disclosed herein; rather it extends to all functionally equivalent structures, methods and uses, such as are within the scope of the appended claims.

What is claimed is:

1. An apparatus comprising:

a housing having a plurality of fluid channels therethrough comprising at least an inlet channel connected to an outlet channel via a fluid passageway such that fluid is flowable from the inlet channel through the fluid passageway to the outlet channel;

a shuttle configured to move within the housing, the shuttle having an inner surface and a total length defined between a first end of the shuttle and a second opposite end of the shuttle, wherein the first end of the shuttle has an end surface facing the outlet channel;

a bonnet coupled to the housing;

a gate extending outwardly away from the end surface of the shuttle facing the outlet channel towards the outlet channel, wherein the gate has a first end directly facing the outlet channel and a second, opposite end facing the shuttle, wherein the gate tapers inwardly towards the first end; and a hydraulic fluid chamber at least partially defined by the bonnet and the inner surface of the shuttle and configured to apply hydraulic pressure to both the bonnet and the second end of the gate, wherein the end surface of the first end of the shuttle is disposed within the fluid passageway between the inlet channel and the outlet channel, and wherein the hydraulic fluid chamber is configured to apply hydraulic pressure to the bonnet directly and to the second end of the gate directly.

2. The apparatus of claim 1, wherein the hydraulic fluid chamber is at least partially inside the shuttle.

3. The apparatus of claim 1, wherein the gate is fixed relative to the shuttle, wherein the second end at least partially defines the hydraulic fluid chamber.

4. The apparatus of claim 3, further comprising a shuttle nut configured to at least partially secure the gate to the shuttle and wherein the hydraulic fluid chamber is at least partially defined by the shuttle nut.

5. The apparatus of claim 1, further comprising a fluid passage between the bonnet and the shuttle.

6. The apparatus of claim 1, wherein the gate is solid.

7. The apparatus of claim 1, further comprising a seat fixed relative to the housing and proximate one of the plurality of fluid channels, the seat being configured to receive the first end of the gate, wherein the first end of the gate is tapered.

8. A method comprising:

mounting a shuttle to be movable inside a housing that comprises at least an inlet channel, an outlet channel and a fluid passageway connecting the inlet channel and the outlet channel such that fluid is flowable from the inlet channel throughout the fluid passageway to the outlet channel, the shuttle being movable in a first direction and in a second, opposite direction, the shuttle including a peripheral portion and an inner portion, wherein the shuttle has a total length defined between a first end of the shuttle and an opposite second end of the shuttle and the first end of the shuttle has an end surface facing the outlet channel of the housing, wherein the inner portion is located distally farther in the first direction than the peripheral portion;

covering at least a portion of the end surface of the shuttle, that faces the outlet channel, with a shuttle nut; and moving the shuttle within the housing by directing pressurized hydraulic fluid to the peripheral portion and the inner portion of the shuttle, wherein the end surface of the first end of the shuttle is disposed within the fluid passageway between the inlet channel and the outlet channel.

9. The method of claim 8, wherein a hydraulic fluid chamber is at least partially defined by a bonnet, the peripheral portion and the inner portion.

10. The method of claim 8, wherein the shuttle is moved in the second direction by a working fluid.

11. The method of claim 10, further comprising adjusting a position of the shuttle with respect to the housing to control a flow of the working fluid through the housing.

12. The method of claim 10, wherein a flow of the working fluid is between about 12 gallons per minute (about 40 liters per minute) and about 42 gallons per minute (about 160 liters per minute).

13. The method of claim 10, wherein a flow of the working fluid is between about 21 gallons per minute (about 80 liters per minute) and about 32 gallons per minute (about 121 liters per minute).

14. An apparatus comprising:

a housing having a plurality of fluid channels therethrough comprising at least an inlet channel connected to an outlet channel via a fluid passageway such that fluid is flowable from the inlet channel through the fluid passageway to the outlet channel;

a shuttle configured to move within the housing, the shuttle having an inner surface and a total length defined between a first end of the shuttle and a second opposite end of the shuttle, wherein the first end of the shuttle has an end surface facing the outlet channel;

a bonnet coupled to the housing;

a gate extending outwardly away from the end surface of the shuttle facing the outlet channel towards the outlet channel, wherein the gate has a first end directly facing the outlet channel and a second, opposite end facing the shuttle, wherein the gate tapers inwardly towards the first end;

a hydraulic fluid chamber at least partially defined by the bonnet and the inner surface of the shuttle and configured to apply hydraulic pressure to both the bonnet and the second end of the gate; and a shuttle nut configured to at least partially secure the gate to the shuttle and wherein the hydraulic fluid chamber is at least partially defined by the shuttle nut, wherein the end surface of the first end of the shuttle is disposed within the fluid passageway between the inlet channel and the outlet channel, and wherein the gate is fixed relative to the shuttle, wherein the second end at least partially defines the hydraulic fluid chamber.

15. The apparatus of claim 14, wherein the hydraulic fluid chamber is at least partially inside the shuttle.

16. The apparatus of claim 14, further comprising a fluid passage between the bonnet and the shuttle.

17. The apparatus of claim 14, wherein the gate is solid.

18. The apparatus of claim 14, further comprising a seat fixed relative to the housing and proximate one of the plurality of fluid channels, the seat being configured to receive the first end of the gate, wherein the first end of the gate is tapered.

* * * * *